US010627189B2

(12) United States Patent
Faifer

(10) Patent No.: US 10,627,189 B2
(45) Date of Patent: Apr. 21, 2020

(54) STABILIZING DEVICE FOR A SMALL ARMS WEAPON

(71) Applicant: Sagi Faifer, Mishmar Hashiva (IL)

(72) Inventor: Sagi Faifer, Mishmar Hashiva (IL)

( * ) Notice: Subject to any disclaimer, the term of this patent is extended or adjusted under 35 U.S.C. 154(b) by 0 days.

(21) Appl. No.: 16/253,176

(22) Filed: Jan. 21, 2019

(65) Prior Publication Data

US 2019/0226798 A1 Jul. 25, 2019

Related U.S. Application Data

(60) Provisional application No. 62/620,907, filed on Jan. 23, 2018, provisional application No. 62/620,886, filed on Jan. 23, 2018.

(51) Int. Cl.

| | |
|---|---|
| ***F41C 23/12*** | (2006.01) |
| ***F41C 27/22*** | (2006.01) |
| ***F41C 33/00*** | (2006.01) |
| ***F41A 3/72*** | (2006.01) |
| ***F41C 23/04*** | (2006.01) |

(52) U.S. Cl.

CPC ..... *F41C 23/12* (2013.01); *F41A 3/72* (2013.01); *F41C 23/04* (2013.01); *F41C 27/22* (2013.01); *F41C 33/001* (2013.01)

(58) Field of Classification Search

CPC ..... F41A 11/04; F41A 23/08; F41A 23/10; F41A 23/12; F41A 23/14; F41C 23/00; F41C 23/04; F41C 23/10; F41C 23/12; F41C 23/14; F41C 23/20

See application file for complete search history.

(56) References Cited

U.S. PATENT DOCUMENTS

| | | | |
|---|---|---|---|
| 22,626 | A | 1/1859 | Colt |
| 28,433 | A | 5/1860 | Alsop |
| 32,003 | A | 4/1861 | Savage |
| 46,365 | A | 2/1865 | Kinman |
| 202,946 | A | 4/1878 | Johnson |
| 223,926 | A | 1/1880 | Kinney |
| 287,741 | A | 10/1883 | Vickers, Jr. |
| 305,537 | A | 9/1884 | Schwatka |
| 461,480 | A | 10/1891 | Kellar |
| 517,555 | A | 4/1894 | Reed |
| 562,487 | A | 6/1896 | Quackenbush |
| 570,145 | A | 10/1896 | Pittavino |
| 593,890 | A | 11/1897 | Houston |

(Continued)

*Primary Examiner* — Derrick R Morgan

(74) *Attorney, Agent, or Firm* — Law Office of Arthur M. Antonelli, PLLC

(57) ABSTRACT

A stabilizing device for a small arms weapon is disclosed. The stabilizing device may include a housing, a starboard side support member, a port side support member, and a primary hinge pin. The primary hinge pin, the starboard side support member, and the port side support member may form a joint. The stabilizing device further may include a webbing. The webbing may include one end secured to the starboard side support member and another end secured to the port side support member. The webbing may form a sling. The sling may be configured and dimensioned to rest on a body disposed between the first base and the second base. The body may be the forearm of an operator grasping the small arms weapon in a single hand. In one embodiment, the stabilizing device for a small arms weapon is connected to a pistol chassis.

2 Claims, 14 Drawing Sheets

(56) References Cited

U.S. PATENT DOCUMENTS 632,098 A 8/1899 Capps
681,392 A 8/1901 Fugate
723,545 A 3/1903 Phillips
815,609 A 3/1906 Martin
816,074 A 3/1906 Cole
899,617 A 9/1908 Renfors et al.
914,675 A 3/1909 Renfors
931,328 A 8/1909 Marble
1,016,695 A 2/1912 Kimmel
1,027,556 A 5/1912 Marshall
1,111,905 A 9/1914 Keeran
1,150,763 A 8/1915 High
1,195,055 A 8/1916 McNeal
1,196,822 A * 9/1916 Sues ..... F41C 23/14 42/73
1,206,234 A 11/1916 Lovell
1,222,264 A 4/1917 Cabanne
1,260,285 A 3/1918 Cordell
1,266,632 A 5/1918 Sachs
1,266,633 A 5/1918 Sachs
1,276,572 A 8/1918 Rodgers
1,283,015 A 10/1918 Yung
1,315,215 A 9/1919 Davidson
1,340,127 A 11/1920 Welch
1,367,996 A 2/1921 Sussman
1,371,899 A 3/1921 Jenks et al.
1,431,058 A * 10/1922 Sutter ..... F41A 23/08 42/94
1,452,123 A 4/1923 McCrudden
1,477,445 A 12/1923 Petritsch
1,497,794 A 6/1924 Saunders
1,519,123 A 12/1924 Edwards
1,554,556 A 9/1925 Camus
1,557,865 A 10/1925 Neel et al.
1,569,901 A 1/1926 Virdin
1,606,609 A 11/1926 Wheeler, Jr.
1,671,281 A * 5/1928 Gorton ..... F41A 23/12 89/40.06
1,680,186 A 8/1928 Von Frommer
1,877,016 A 9/1932 Munson
2,139,691 A 12/1938 Michal, Jr.
2,293,128 A 8/1942 Fortin
2,424,194 A 7/1947 Sampson et al.
2,433,151 A 12/1947 Parsons
2,439,137 A 4/1948 Keller
2,441,487 A 5/1948 Howard
2,456,280 A 12/1948 Humeston
2,495,977 A 1/1950 Madsen
2,539,008 A 1/1951 Brookhyser
2,611,204 A 9/1952 Robinson, Jr.
2,683,948 A 7/1954 Catron
2,789,742 A 4/1957 De Salvo
2,873,902 A 2/1959 Decker
3,011,283 A 12/1961 Lunn et al.
3,100,357 A 8/1963 Tellie
3,162,966 A 10/1964 La Coss
3,184,877 A 5/1965 Andrews
3,200,528 A * 8/1965 Christensen ..... F41C 23/12 42/94
3,209,481 A 10/1965 Gilbert
3,235,997 A * 2/1966 Stoner ..... F41A 23/08 42/94
3,369,316 A 2/1968 Miller
3,388,494 A 6/1968 Kimball
3,442,042 A 5/1969 Gilbert
3,553,878 A 1/1971 Canon
3,609,902 A 10/1971 Casull
3,641,694 A 2/1972 Seidel et al.
3,648,396 A 3/1972 Smith
3,685,194 A 8/1972 Coon
3,740,886 A 6/1973 Canon
3,782,019 A * 1/1974 Venturini ..... F41C 23/04 42/72
3,793,759 A 2/1974 Deckard
3,798,818 A 3/1974 Casul
D231,828 S 6/1974 Canon
3,857,323 A 12/1974 Ruger et al.
3,861,273 A 1/1975 Seidel et al.
4,196,742 A 4/1980 Owen
4,271,623 A 6/1981 Beretta
4,291,482 A 9/1981 Bresan
4,296,566 A 10/1981 Campos
4,321,765 A 5/1982 Gillum
4,397,112 A * 8/1983 York ..... F41A 23/08 42/94
4,398,365 A 8/1983 Pokhis
4,513,523 A 4/1985 Gal
4,515,301 A 5/1985 A'Costa
4,579,037 A 4/1986 Gillum
4,601,123 A 7/1986 Swearengen et al.
4,640,036 A 2/1987 Gal
4,660,311 A 4/1987 Breitfeld et al.
4,674,472 A 6/1987 Reis
4,735,007 A 4/1988 Gal
4,735,008 A 4/1988 Williams
4,776,124 A * 10/1988 Clifton ..... F41A 23/08 42/94
4,788,785 A 12/1988 White
4,790,095 A 12/1988 Campos
4,843,749 A 7/1989 Griffith
4,858,359 A 8/1989 Danz
4,989,358 A 2/1991 Aronson et al.
5,018,294 A 5/1991 McGuffee
5,056,253 A 10/1991 Willumsen
5,092,070 A 3/1992 Perkins
5,180,874 A 1/1993 Troncoso, Jr.
5,351,428 A 10/1994 Graham
5,379,179 A 1/1995 Graves
5,445,479 A 8/1995 Hillinger
5,479,736 A 1/1996 Forrester
5,528,846 A 6/1996 Baggett
5,761,842 A 6/1998 Mantymaa
5,778,588 A 7/1998 Allen, III et al.
5,778,589 A 7/1998 Teague
5,819,461 A 10/1998 Killian
D400,954 S 11/1998 Ealovega
5,852,253 A 12/1998 Baricos et al.
D411,280 S 6/1999 Van Ek et al.
5,924,233 A 7/1999 Stobel
5,930,931 A 8/1999 Watson
5,930,933 A * 8/1999 Schleicher ..... F41A 23/16 42/94
6,016,620 A * 1/2000 Morgan ..... F41C 27/00 42/94
6,055,760 A 5/2000 Cuson et al.
6,070,809 A 6/2000 Price
6,112,448 A 9/2000 Gray et al.
6,161,741 A 12/2000 French
6,250,009 B1 6/2001 Leontuk
6,267,335 B1 7/2001 Barrett
6,318,014 B1 11/2001 Porter
6,324,728 B1 12/2001 Blankenheim
6,367,187 B2 4/2002 Bubits
6,560,911 B2 5/2003 Sharp
6,634,128 B1 10/2003 Vastag
6,678,986 B2 1/2004 Roush
6,729,061 B1 5/2004 DeJarnette, Jr.
6,789,344 B2 9/2004 Cain
6,829,856 B1 12/2004 Moorman
6,920,713 B1 7/2005 Love
7,028,427 B2 4/2006 Crawford
7,059,502 B2 6/2006 Johnson
7,065,914 B1 6/2006 Wagner, II
7,197,844 B2 4/2007 Benson
7,398,616 B1 7/2008 Weir
7,437,847 B1 10/2008 Mabry
7,552,557 B1 6/2009 Mabry
7,637,882 B2 12/2009 Carman, Jr. et al.
7,698,848 B1 4/2010 Bentley
7,849,626 B2 12/2010 Fluhr
D631,122 S 1/2011 Domagtoy
7,909,301 B2 3/2011 Faifer
7,992,336 B2 8/2011 Phillips

(56) References Cited

U.S. PATENT DOCUMENTS 8,051,596 B1 11/2011 Thomas et al.
8,061,072 B1 11/2011 Crose
8,091,264 B2 * 1/2012 Goertz ..... F41A 19/10 42/1.11
8,109,026 B1 2/2012 Bentley et al.
8,191,301 B2 6/2012 Hatfield
8,205,374 B2 6/2012 Lamm
8,438,771 B1 5/2013 Boone
8,448,366 B2 5/2013 Faifer
D683,808 S 6/2013 Elkaim
8,549,783 B2 10/2013 Marquez
8,677,669 B1 3/2014 Vesligaj
D706,896 S 6/2014 Bosco
8,776,421 B1 7/2014 Vesligaj
D716,406 S 10/2014 Storey
8,869,444 B2 * 10/2014 Bosco ..... F41C 33/001 42/71.01
8,887,432 B2 11/2014 Oz
9,354,012 B2 * 5/2016 Faifer ..... F41A 23/10
9,354,021 B2 * 5/2016 Bosco ..... F41C 33/001
D764,622 S * 8/2016 Bosco ..... D22/108
9,441,898 B2 9/2016 Istvanovics et al.
9,453,699 B1 9/2016 Barnett
9,459,073 B1 10/2016 Kloeppel
9,500,439 B1 11/2016 Dietrich et al.
D774,618 S 12/2016 Bosco et al.
9,546,843 B2 1/2017 Sroufe et al.
D780,279 S 2/2017 Bosco et al.
9,631,893 B2 4/2017 Glimer
D785,744 S 5/2017 Bosco et al.
9,651,335 B2 5/2017 Denbleyker
9,664,477 B1 * 5/2017 Reavis, III ..... F41C 27/22
D792,936 S 7/2017 Eitan et al.
D792,937 S 7/2017 Eitan et al.
9,696,110 B2 7/2017 Hollis
9,746,283 B2 8/2017 Braun
D801,467 S 10/2017 Rodgers et al.
10,165,765 B1 * 1/2019 Ching ..... A01K 81/00
2002/0007579 A1 1/2002 Bubits
2002/0078617 A1 * 6/2002 Percival ..... F41A 23/12 42/94
2005/0115140 A1 6/2005 Little
2005/0235546 A1 10/2005 Wonisch et al.
2005/0262753 A1 12/2005 Lahti
2007/0017138 A1 1/2007 Young
2008/0060247 A1 3/2008 Thomele et al.
2009/0038200 A1 * 2/2009 Keng ..... F41A 23/10 42/94
2009/0049731 A1 * 2/2009 Seuk ..... F41A 23/16 42/94
2009/0282718 A1 11/2009 Bartley
2010/0084524 A1 * 4/2010 Faifer ..... F16M 11/041 248/170
2010/0154272 A1 6/2010 Lamm
2011/0030258 A1 2/2011 Fiatikchi et al.
2011/0107644 A1 5/2011 Faifer
2011/0131861 A1 * 6/2011 Seuk ..... F41C 23/14 42/94
2011/0154710 A1 6/2011 Hatfield
2012/0131829 A1 5/2012 Fistikchi et al.
2012/0266513 A1 * 10/2012 Gnesda ..... F41A 23/08 42/72
2013/0134286 A1 * 5/2013 Yan ..... F16M 11/00 248/544
2013/0167424 A1 7/2013 Nail et al.
2013/0185975 A1 7/2013 Johnson
2014/0053447 A1 2/2014 Singh
2014/0144061 A1 * 5/2014 Bosco ..... F41C 33/001 42/94
2014/0182181 A1 7/2014 Bosco
2015/0285577 A1 * 10/2015 Faifer ..... F41A 23/10 42/94
2016/0265872 A1 9/2016 Tarazi
2016/0282084 A1 9/2016 Hollis
2017/0082389 A1 * 3/2017 Dix ..... F41A 27/12
2017/0153084 A1 6/2017 Tarazi
2017/0248385 A1 * 8/2017 Yehle ..... F41A 23/10
2018/0058794 A1 * 3/2018 Scalf ..... F41A 23/10
2018/0216907 A1 * 8/2018 Roberts ..... F41A 23/10
2018/0224234 A1 * 8/2018 Macy ..... F41A 19/15
2019/0017777 A1 * 1/2019 Wilson ..... F41C 23/12
2019/0041156 A1 * 2/2019 Beachli ..... F41A 23/10
2019/0063869 A1 * 2/2019 Keller ..... F41C 23/10
2019/0195595 A1 * 6/2019 Kielsmeier ..... F41C 23/04

* cited by examiner

FIG. 17
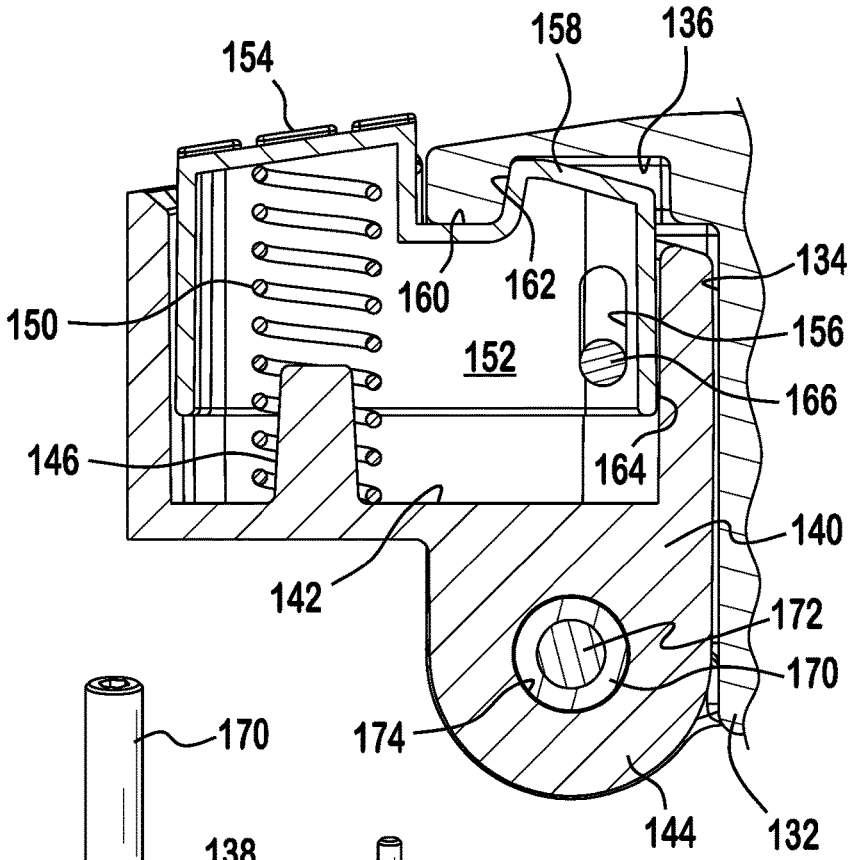
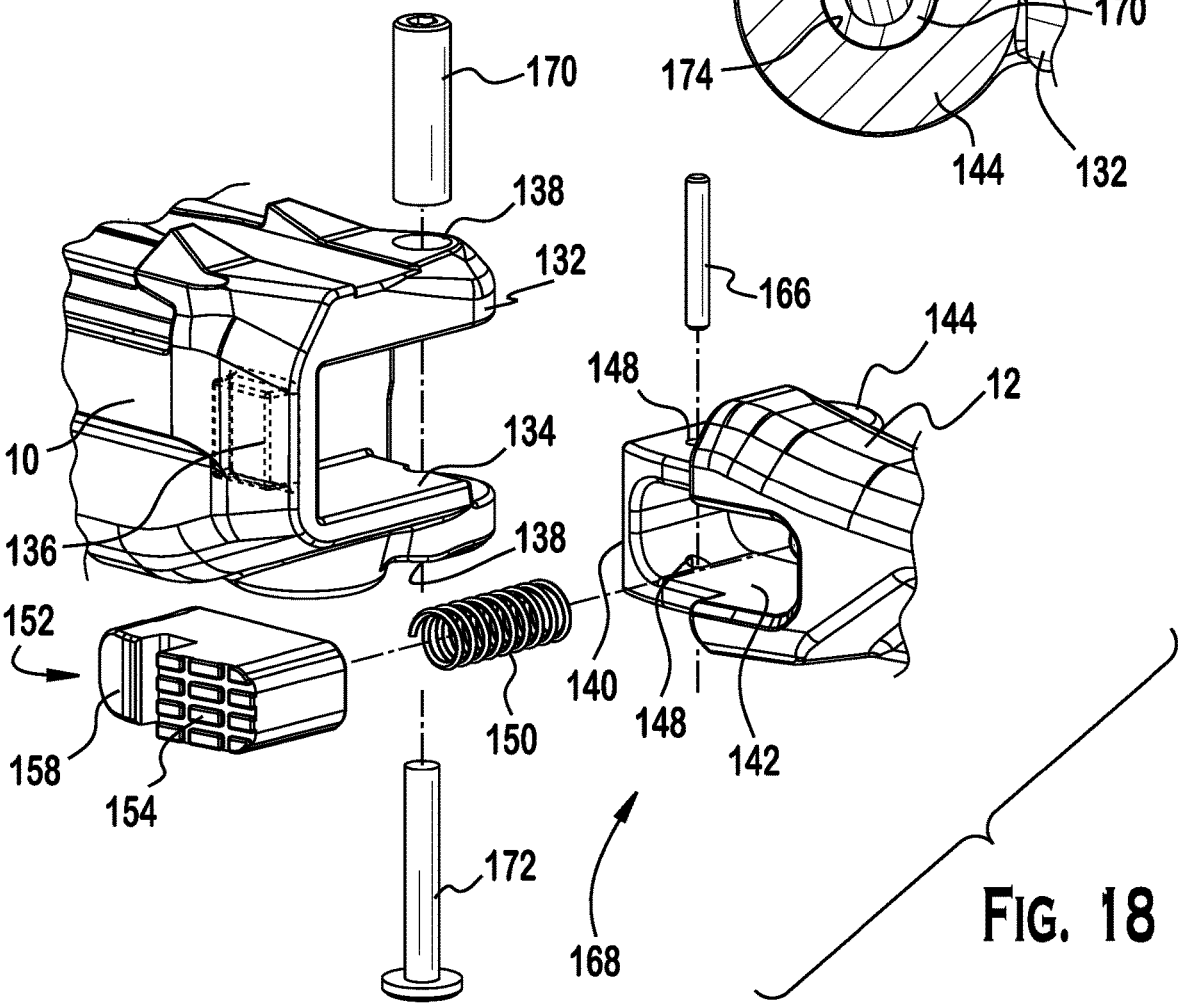
FIG. 18

STABILIZING DEVICE FOR A SMALL ARMS WEAPON

CROSS-REFERENCE TO RELATED APPLICATIONS

This application claims the benefit of U.S. Provisional Application No. 62/620,907 filed on Jan. 23, 2018. Also, this application claims the benefit of U.S. Provisional Application No. 62/620,886 filed on Jan. 23, 2018. The disclosure of each of these applications is incorporated by reference herein in their entirety.

FIELD OF THE INVENTION

The invention generally relates to a stabilizing device for a small arms weapon. More particularly, the invention relates to a forearm supported stabilizing device for a firearm or pistol chassis.

BACKGROUND

Attachments for pistols are known in the related art. These attachments may be secured to a pistol to provide a platform for mounting tactical accessories. These attachments may be cumbersome to assemble, handle or deploy.

SUMMARY

Hence, the present disclosure is directed toward a forearm supported stabilizing device for a small arms weapon. More particularly, a stabilizing device for a small arms weapon is disclosed. The stabilizing device may include an elongated member which further may include a distal end for connecting to a small arms weapon, a proximal end spaced from the distal end along a first longitudinal axis, and a housing near the proximal end of the elongated member. The housing may include a front wall which may include a front borehole, a rear wall which may include a rear borehole, and a chamber disposed in the housing between the front wall and the rear wall. The stabilizing device further may include a primary hinge pin positioned in the front borehole and the rear bore hole.

Additionally, the stabilizing device may include a starboard side support member. The starboard side support member may include a first leading element and a first base. The first leading element may include a first interior ring structure disposed about the primary hinge pin. Also, the stabilizing device may include a port side support member. The port side support member may include a second leading element and a second base. The second leading element may include a second interior ring structure disposed about the primary hinge pin. The primary hinge pin, the first interior ring structure, and the second interior ring structure form a joint.

A spring may be disposed next to the first interior ring structure and the second interior ring structure. The spring may be configured and dimensioned to bias the first base and the second base toward each other.

The stabilizing device further may include a webbing. The webbing may include one end secured to the first base and another end secured to the second base. The webbing may form a sling between the starboard side support member and the port side support member. The sling may be configured and dimensioned to rest on a body disposed between the first base and the second base. The body may be the forearm of an operator grasping the small arms weapon in a single hand.

In one embodiment, the stabilizing device for a small arms weapon is connected to a pistol chassis.

DESCRIPTION OF THE DRAWINGS

In the accompanying drawings, which form part of this specification and are to be read in conjunction therewith and in which like reference numerals are used to indicate like parts in the various views:

FIG. 17 is a partial sectional view of the coupling element and latching mechanism of FIG. 1, in a locked configuration;

FIG. 18 is an exploded view of the coupling element and latching mechanism of FIG. 1;

DESCRIPTION

Figure 1:
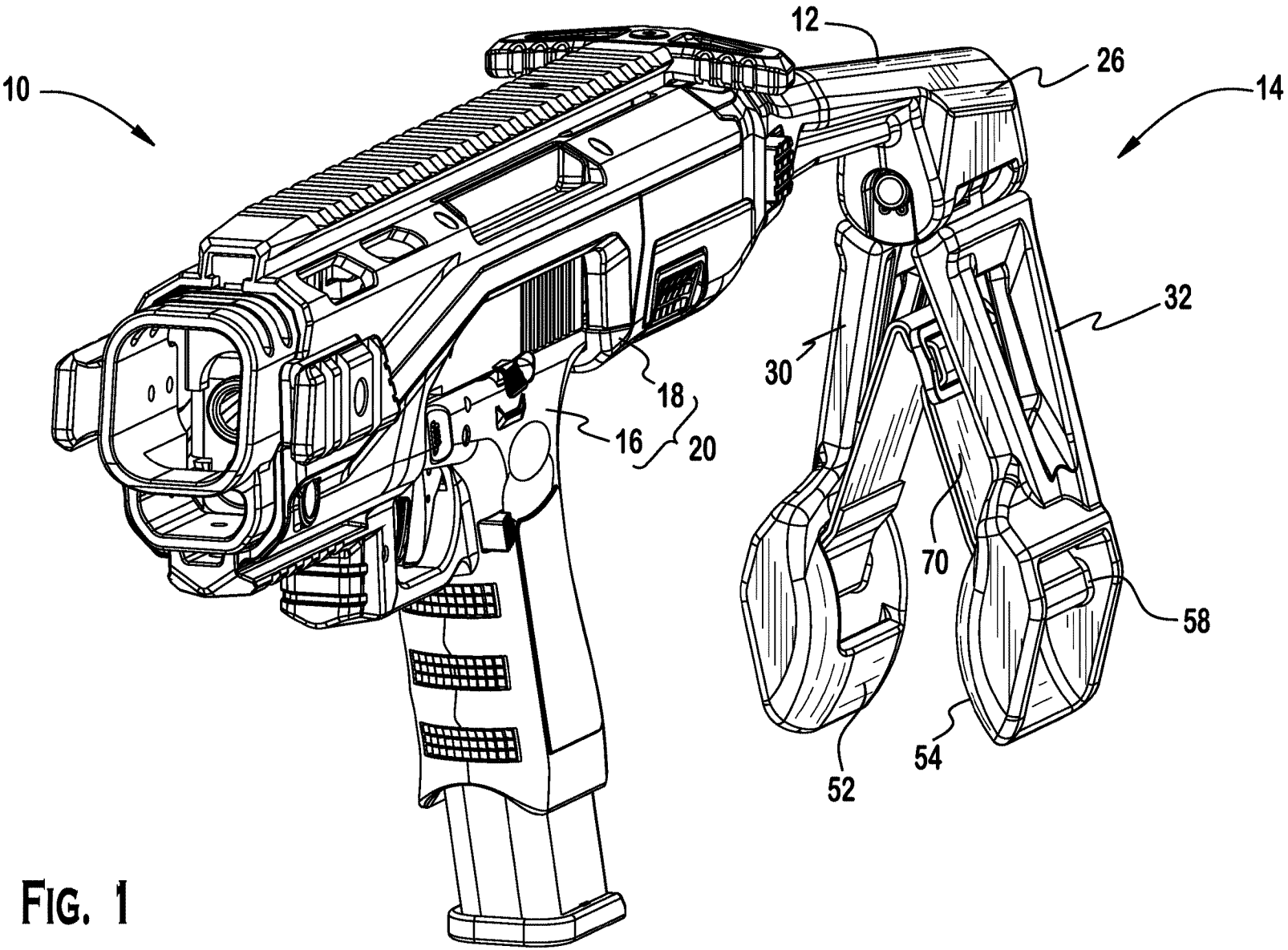
FIG. 1 is a perspective view of an exemplary small arms weapon and forearm supported stabilizing device, the forearm supported stabilizing device being in a deployed configuration.

FIG. 1 shows a perspective view of an exemplary small arms weapon 10 connected to an illustrative embodiment of a proximal accessory 12 that includes a forearm supported stabilizing device 14. Although the small arms weapon of FIG. 1 includes a pistol 16 and a chassis 18, other small arm weapons 10 may be substituted in their places and connected to the proximal accessory.

Figure 2:
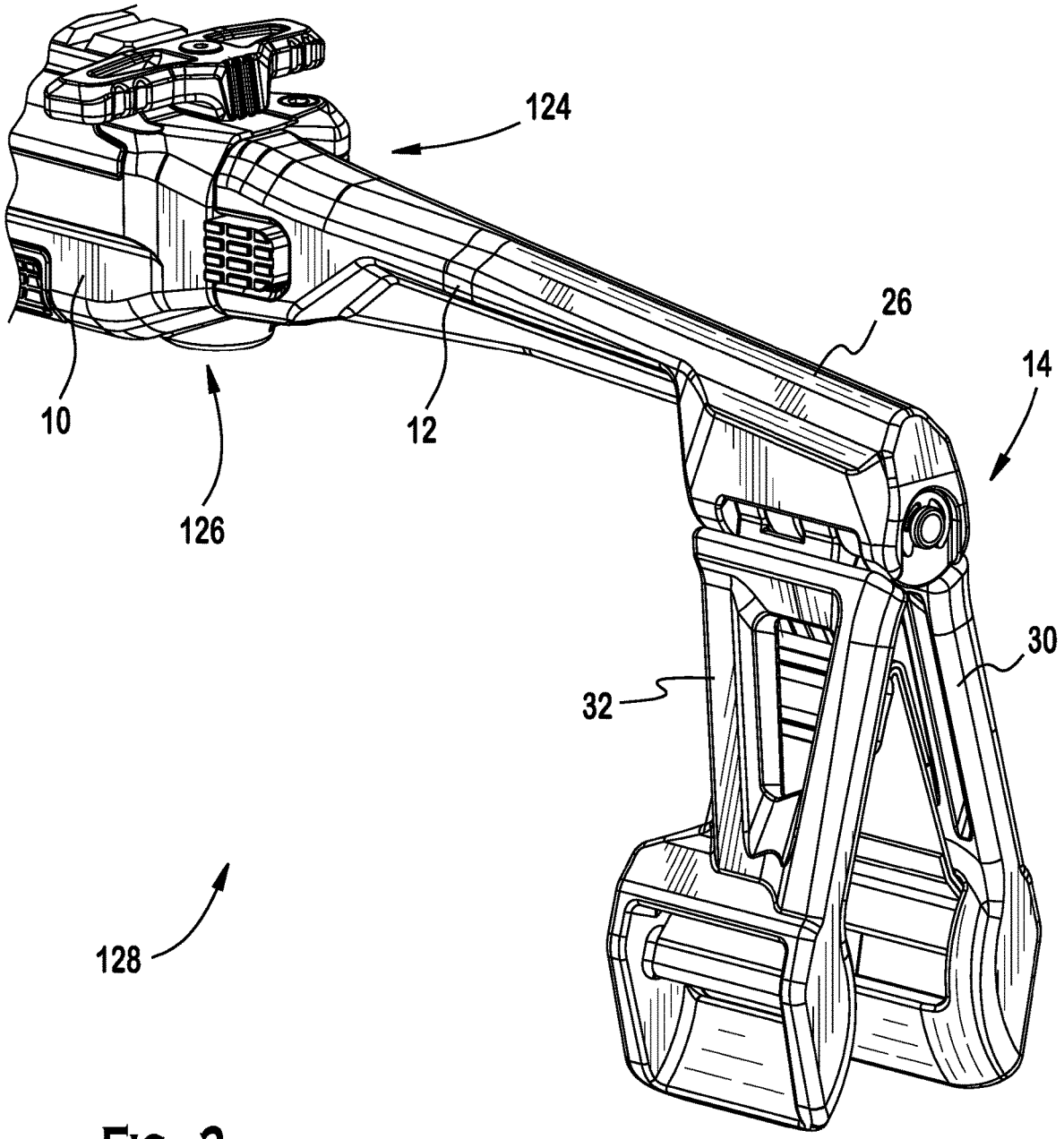
FIG. 2 is a perspective view of part of the small arms weapon and the forearm supported stabilizing device of FIG. 1.

In the disclosed embodiment, the pistol 12 and the chassis 14 may be combined to form a firearm apparatus 20. The proximal accessory 12 may be secured to the firearm apparatus 15. The distal end 22 of the proximal accessory 12 may be integral to the small arms weapon or may be connected thereto. The proximal accessory 12 may further include a forearm supported stabilizing device 14. The forearm supported stabilizing device 14 may be adapted to engage with the forearm of an operator of the small arms weapon 10 to aid in positioning (see e.g., FIG. 13) or stabilizing (see e.g., FIG. 14) the small arms weapon during use (see e.g., FIG. 15). Referring to FIG. 2, the forearm supported stabilizing device 14 may be spaced from the distal end 22 of the proximal accessory by a stein 24. The stem may further include a housing 26 that includes a chamber 28 (see e.g., FIG. 12) which receives a starboard side support member 30 and a port side support member 32.

Figure 4:
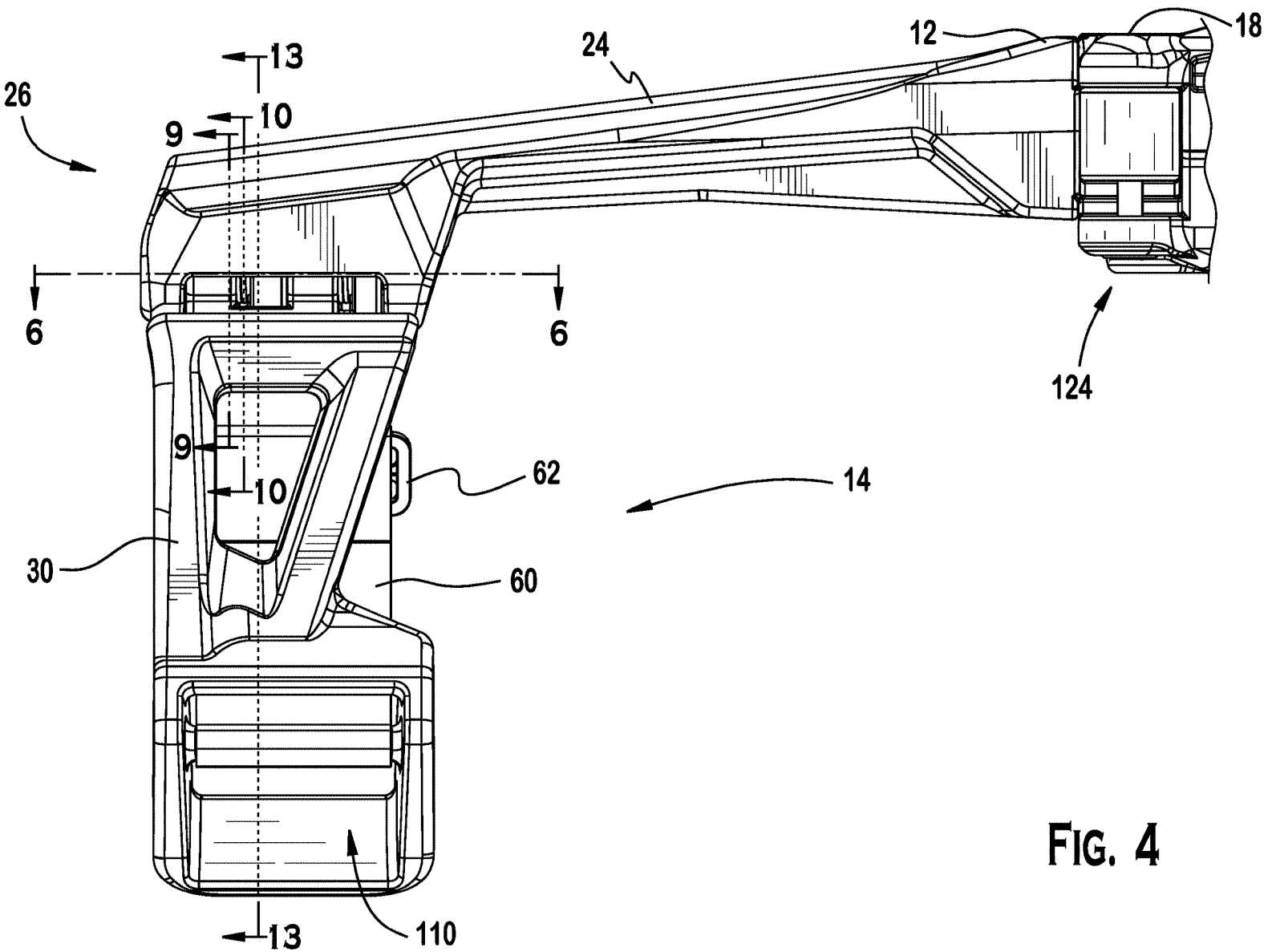
FIG. 4 is a starboard side view of the forearm supported stabilizing device of FIG. 2.
Figure 5:
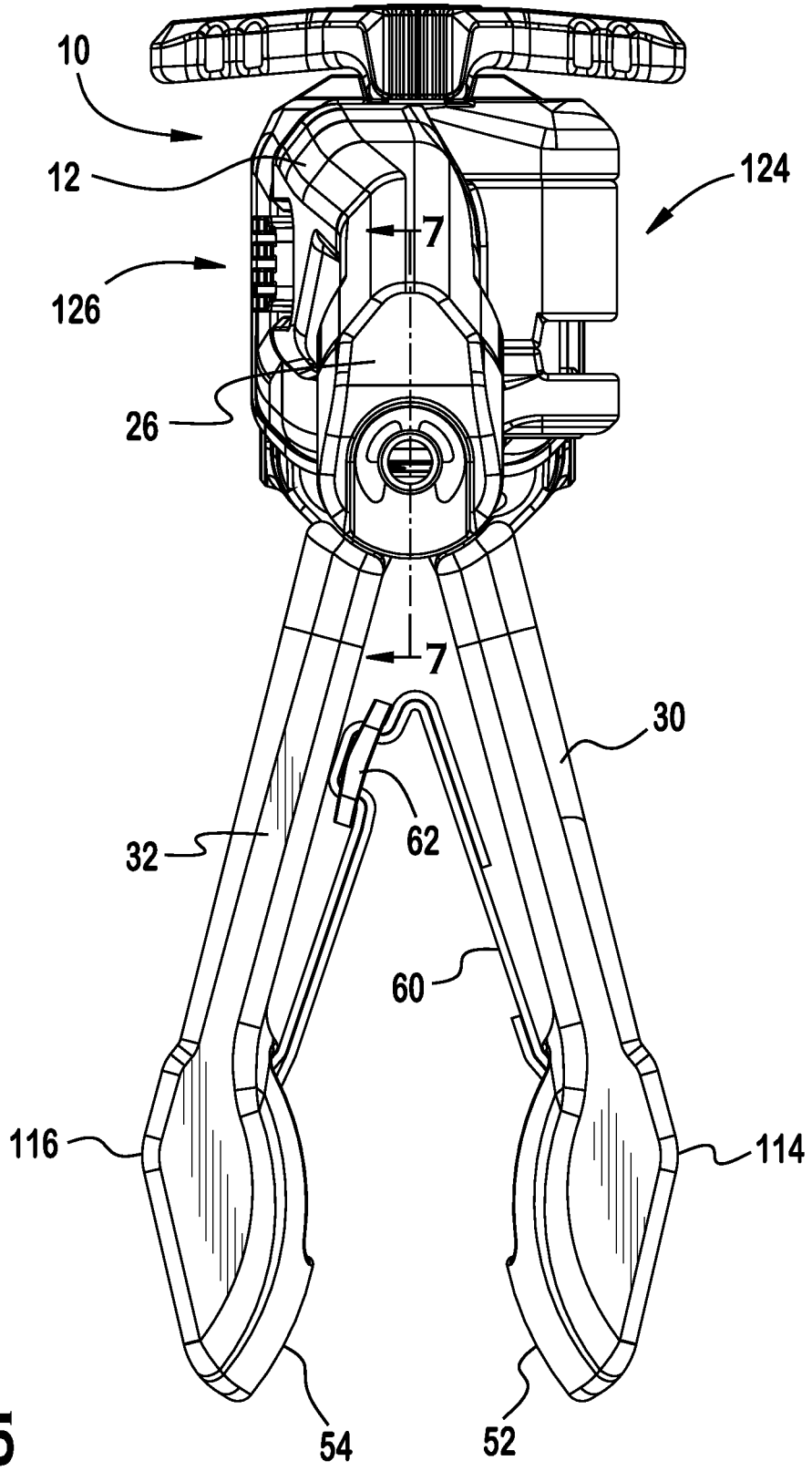
FIG. 5 is a rear view of the small arms weapon and forearm supported stabilizing device of FIG. 1.
Figure 12:
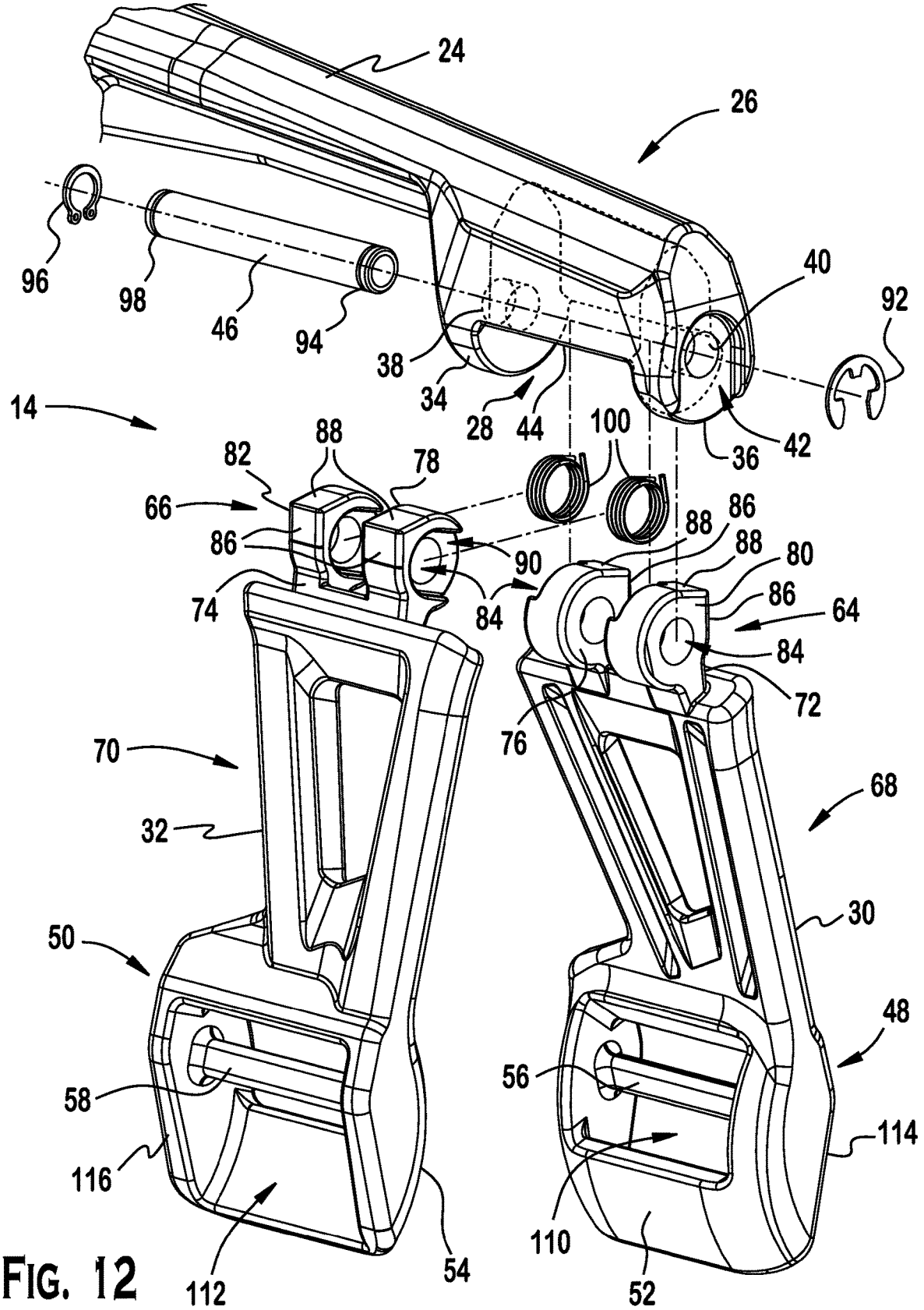
FIG. 12 is an exploded view of the forearm supported stabilizing device of FIG. 2.

Referring to FIG. 12, the housing may include a front wall 34 and a rear wall 36. The chamber may be situated between the front wall and the rear wall. The front wall 34 may include a front borehole 38, and the rear wall 36 may include a rear borehole 40. The front borehole may be aligned with the rear borehole. The rear wall 36 may include a recess 42 around the rear borehole. Further, the housing 26 may define an opening 44 to the chamber between the rear wall and the front wall. The support members 30, 32 may be interposed in the chamber 28 and connected by a primary hinge pin 46 that is disposed in the front borehole and the rear borehole. Each of the support members 30, 32 may include a base 48, 50. Each base 48, 50 may include an inner surface 52, 54 and an anchor 56, 58. Referring to FIG. 4 and FIG. 5, the forearm supported stabilizing device 14 may include a webbing (or strap) 60. One end of the webbing 60 may be secured to or around the port side anchor 58 and the opposite end of the webbing 60 may be secured to or around the starboard side anchor 56. The webbing may have an effective length between the support members. Also, the webbing may include a mechanism (e.g., a buckle 62) which selectively allows for the effective length of the webbing to be increased or decreased.

Figure 10:
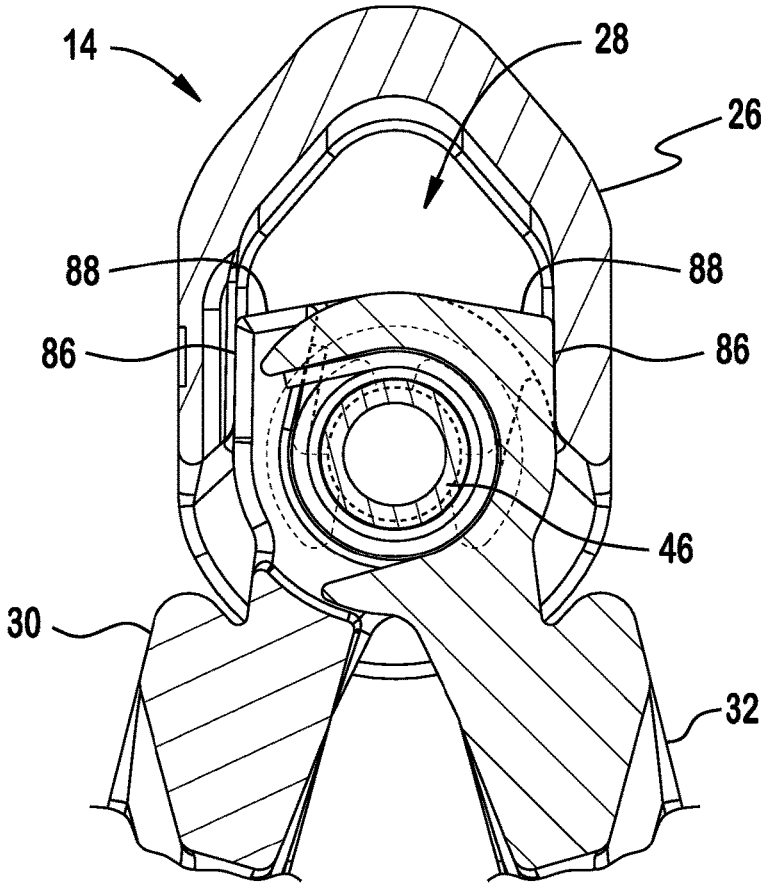
FIG. 10 is a cross-sectional view of the device of FIG. 4 along line 10-10 shown in a closed configuration.
Figure 11:
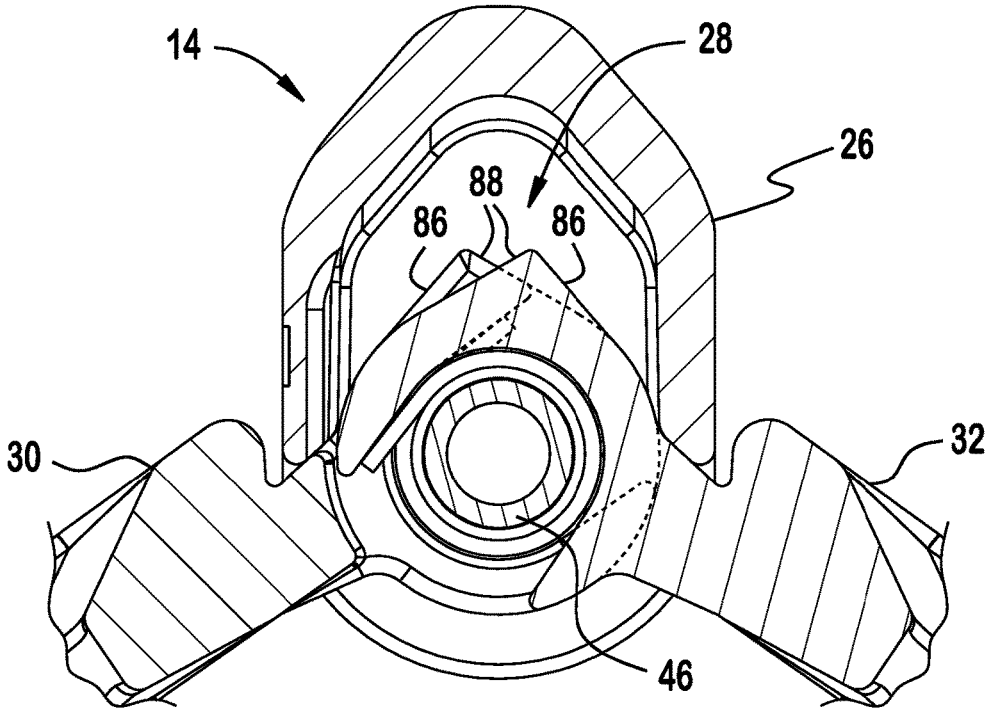
FIG. 11 is a cross-sectional view of the device of FIG. 4 along line 10-10 shown in an open configuration.

Referring to FIG. 12, each support member 30, 32 may include a head 64, 66 that is spaced from the base 48, 50, as well as a frame 68, 70 that connects the head to the base. The head may include a leading element 72, 74. The leading element may include an interior ring structure 76, 78 and an exterior ring structure 80, 82. The interior ring structure and an exterior ring structure may include a bore 84, a side recess 90, and two flat faces 86, 88. The two flat faces may intersect to form a corner. In one example, the two flat faces may form an oblique angle. In another example, the two flat faces may form a right angle. Referring to FIG. 11, one face 88 may define a blocking surface that limits rotation of the base away from the base of the other support member. Referring to FIG. 10, the other face 86 may define another blocking surface that limits rotation of the base toward the base of the other support member.

Referring to FIG. 12, each interior ring structure and exterior ring structure may be received on the primary hinge pin 46. For example, the primary hinge pin 46 may be inserted in the front borehole 38, the respective bores 84 in the leading elements 72, 74 of the starboard side support member 30 and the port side support member 32, as well as in the rear borehole 40. The primary hinge pin may be secured on one side of the housing by a ring clip 92. The ring clip 92 may mate with a circumferential groove 94 in primary hinge pin. Similarly, the opposite end of the primary hinge pin may be secured on the other side of the housing by a retaining ring 96. The retaining ring may interlock with a circumferential groove 98 on the primary hinge pin 46.

Figure 6:
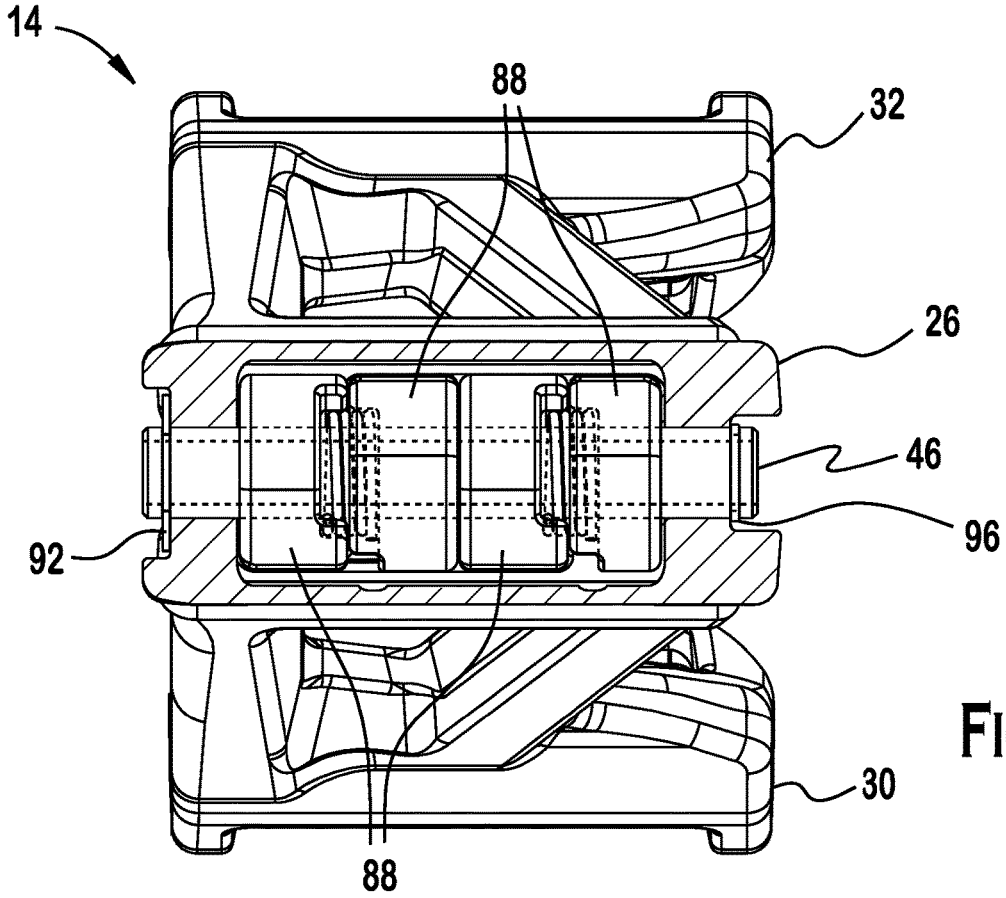
FIG. 6 is a partial sectional view of the device of FIG. 4 along line 6-6.
Figure 7:
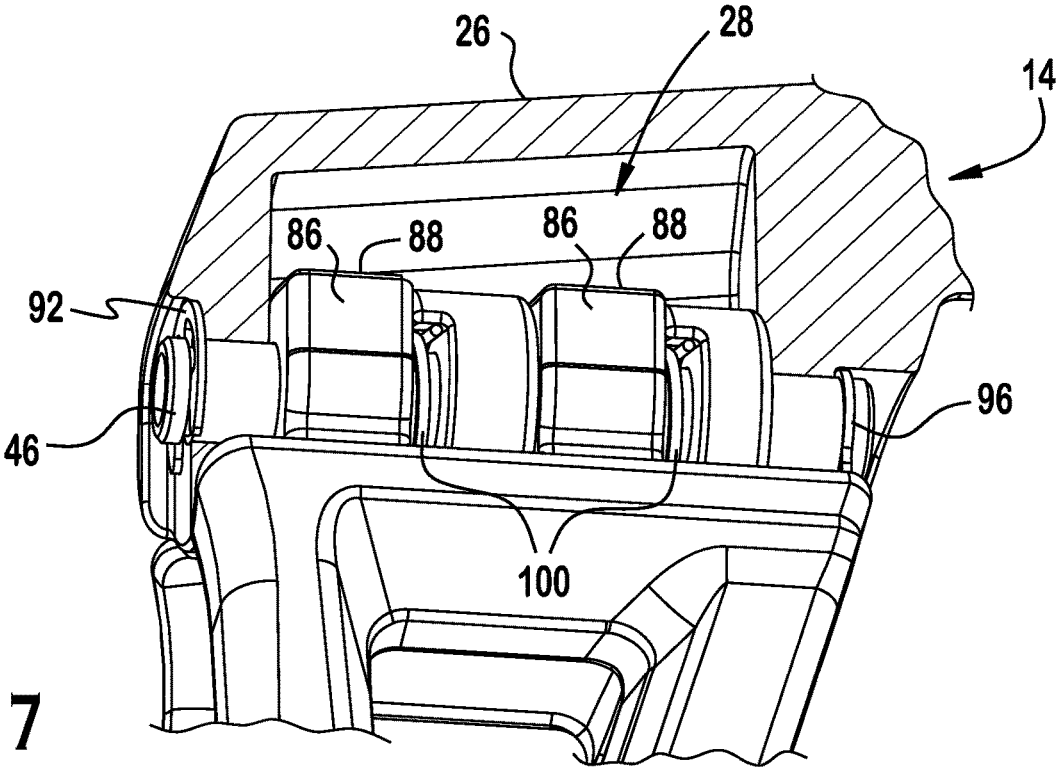
FIG. 7 is a partial sectional view of the device of FIG. 5 along line 7-7.
Figure 8:
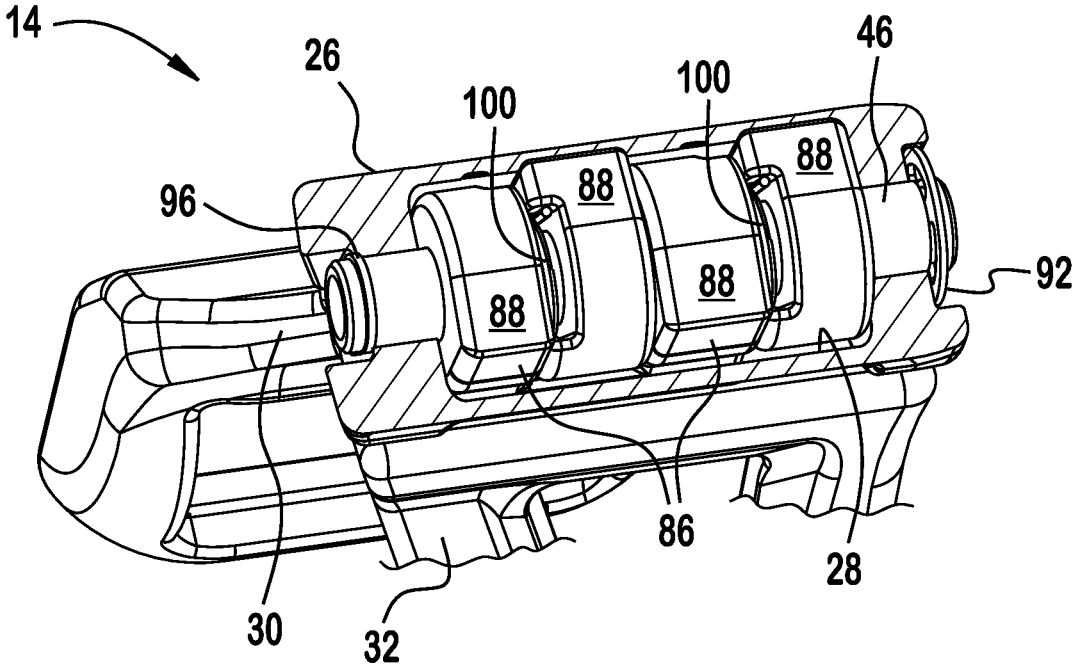
FIG. 8 is a perspective view of FIG. 6.
Figure 9:
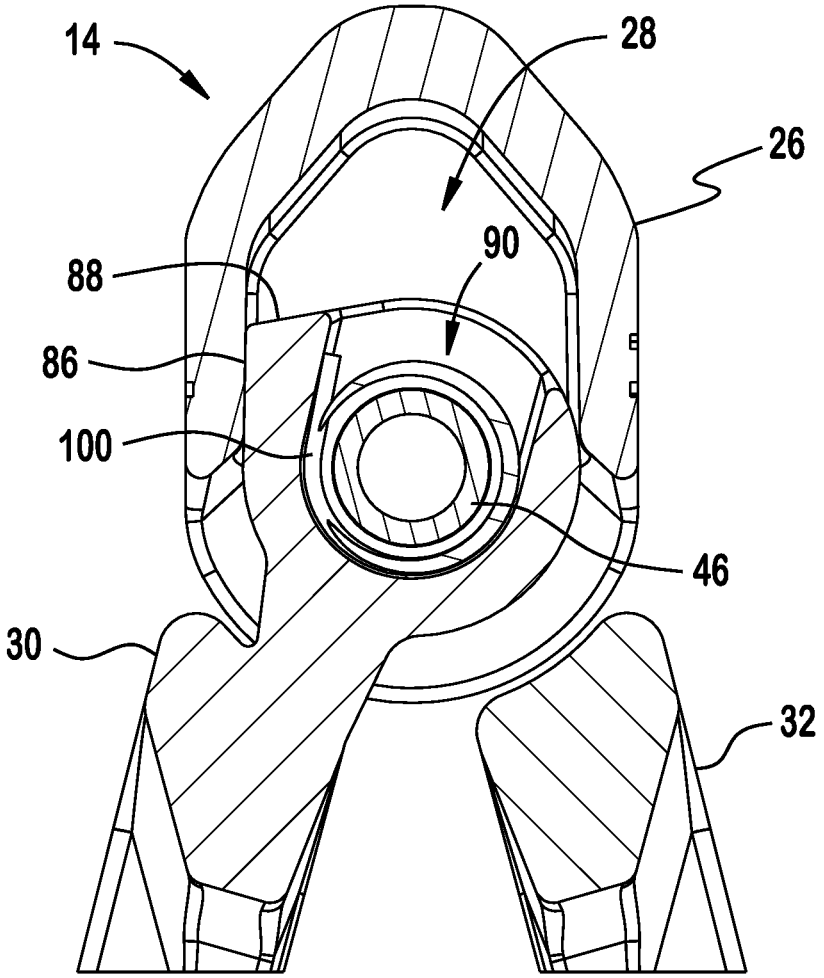
FIG. 9 is a cross sectional view of the device of FIG. 4 along line 9-9.

Referring to FIGS. 6, 7 and 8, the side recesses 90 on the leading element 72 of the starboard support member may face the side recesses 90 on the leading element 74 of the port side support member. A torsion spring 100 may be positioned on the primary hinge pin between the respective recesses 90 of the starboard side and port side support members. The torsion spring(s) 100 may be configured and dimensioned to bias the bases 48, 50 of the respective support members toward each other (see e.g., FIG. 5). Moreover, the torsion spring (s) may bias blocking surface(s) 86 of the respective leading elements against the housing to stop inward rotation of each base (see e.g., FIGS. 9 and 10). Such an orientation of the support arm stabilizing device 14 may be identified as a ready configuration.

Figure 14:
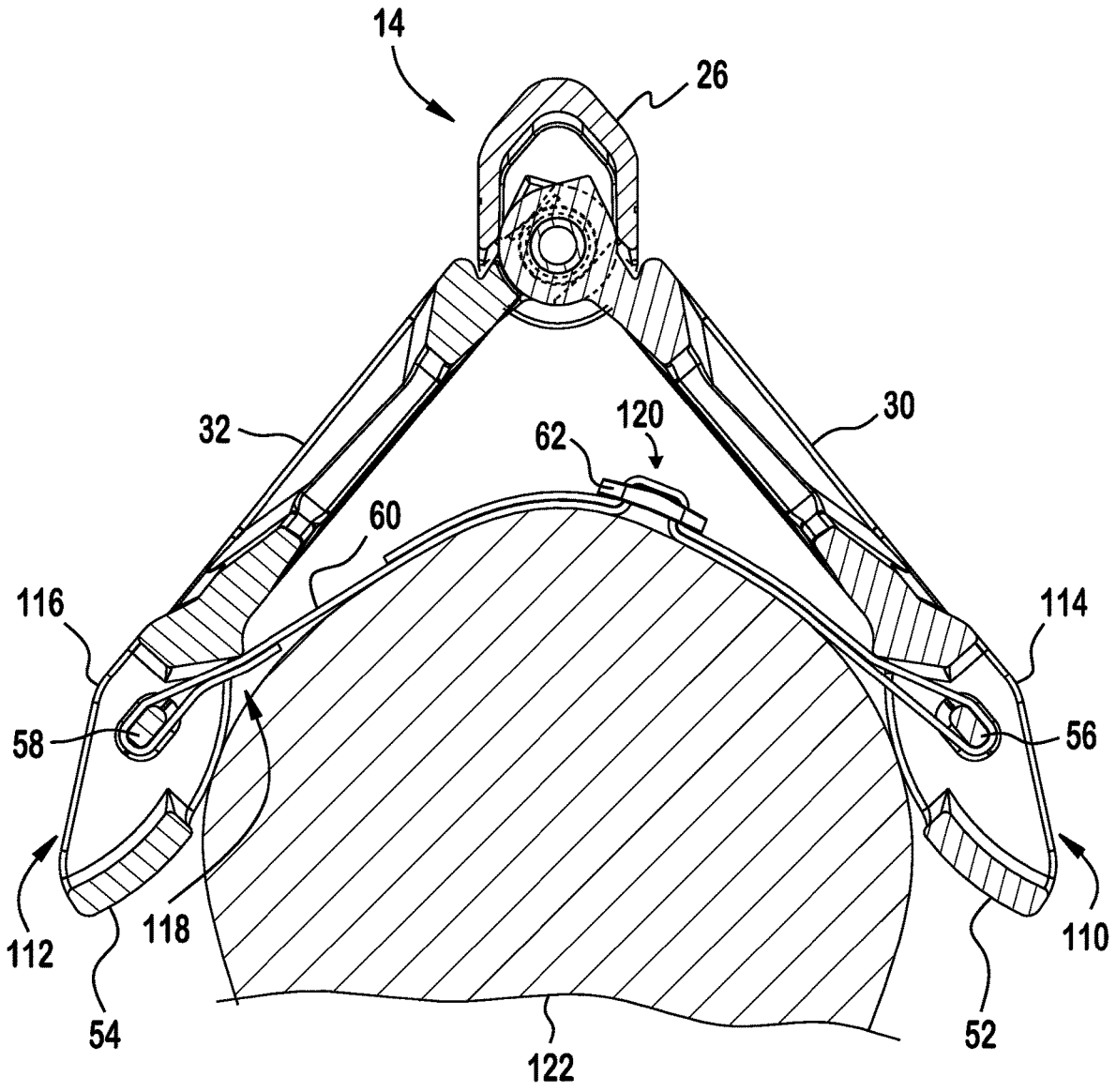
FIG. 14 is a cross-sectional view of the device of FIG. 13 in an open and stabilized configuration.

Referring to FIG. 11, work against the torsion springs) 100 may be required to move the bases 48, 50 of each respective support member away from each other (see also, FIG. 14). Each support member 30, 32 may move independently away from the other support member until the other blocking face 88 of each respective support member contacts the opposite side of the housing. For example, without limitation, each support member 30, 32 may be free to rotate against a spring bias through approximately 80 degrees of travel. Thus, the leading elements 72, 74 of each respective support arm 30, 32 may interleave one with the other, and further may pivot relative to the other as the support arms rotate individually between a generally closed position (see e.g., FIGS. 5, 10, and 15) and an open position (see e.g., FIGS. 11, 14 and 15).

Referring to FIGS. 5, 12, 13 and 14, the base 48, 50 of each support member 30, 32 may include an inner surface 52, 54. The inner surface 52, 54 may be smooth and rounded to facilitate passage of an operator's forearm between the support members during use. Also, each support member 30, 32 may include a passage 110, 112 extending from the inner surface 52, 54 to an exterior surface 114, 116 of the support member. A strut or anchor 56, 58 may be disposed between side walls of the passage 110, 112. The anchor 56, 58 may divide the passage into an upper passage and a lower passage.

Figure 13:
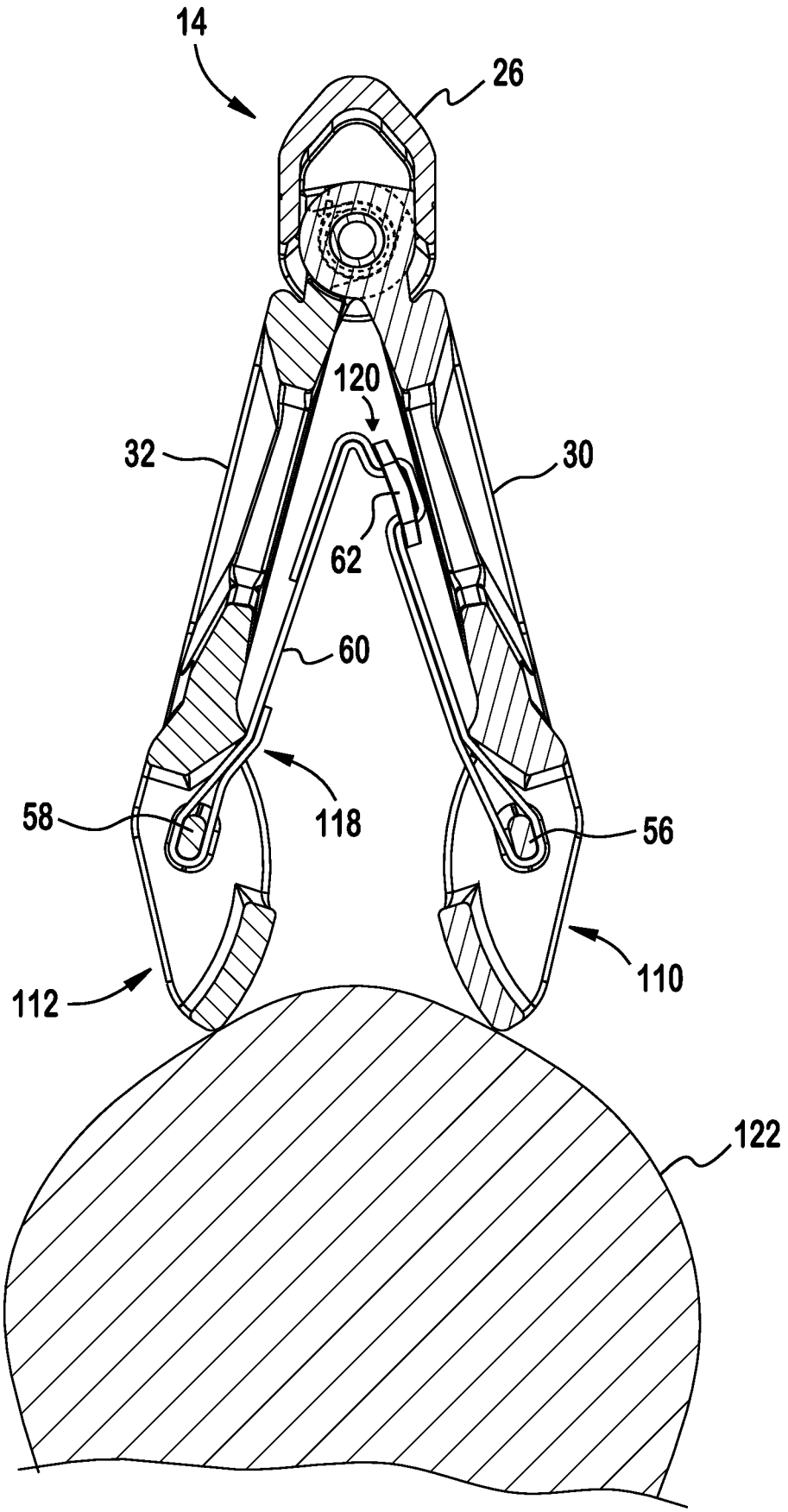
FIG. 13 is a cross-sectional view of the device of FIG. 4 along line 10-10 shown in a closed and stabilized configuration.

As shown in FIG. 13 and FIG. 14, one end of the webbing or strap 70 may be wrapped around the anchor 58 and sewn or otherwise secured (e.g., with Velcro, rivets or a buckle) back on to itself so as to provide a secure connection between the webbing 60 and the anchor 58. In a similar manner, the opposite end of the webbing 60 or strap may be wrapped around the other anchor 56 so as to provide a secure connection between the webbing and the other anchor 56. In the exemplary embodiment, a secure connection at one end of the webbing is a sewn connection 118; whereas, a secure connection at the other portion is a buckled connection 120. The buckled connection 120 may be manipulated to lengthen or shorten the effective length of the webbing or strap that is secured to the respective anchors. Also, the opening in the base may include space for the webbing (or strap) and buckle to be recessed from the exterior portion of each respective base to facilitate a streamlined exterior and prevent snagging of the webbing or strap 60 on the external environment.

Figure 15:
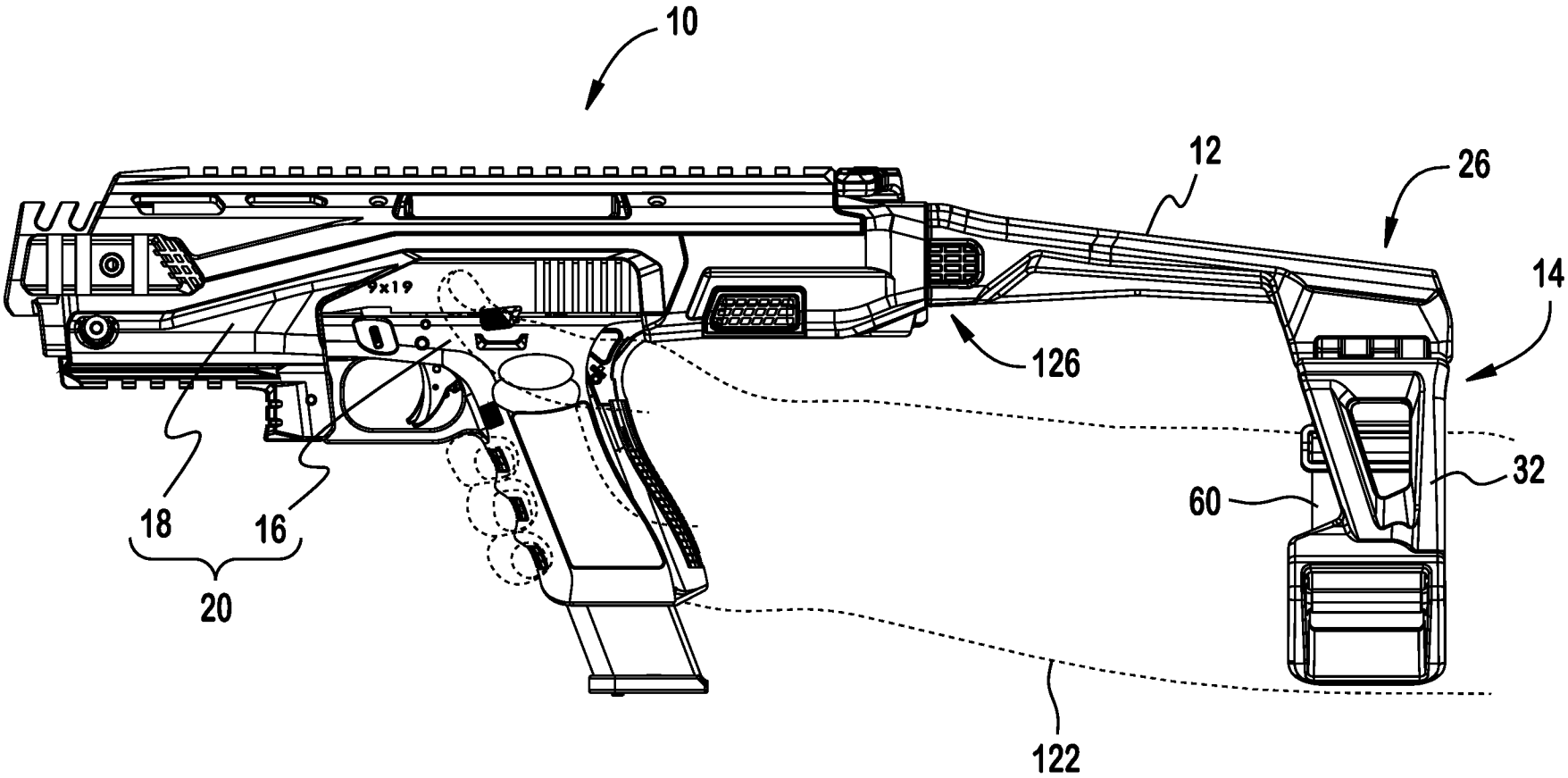
FIG. 15 is a port side view of the small arms weapon and forearm supported stabilizing device of FIG. 1 an open and stabilized configuration.

Referring to FIGS. 14 and 15, the webbing (or strap) 60 and buckle 62 may rest firmly on the forearm 122 of an operator that is properly grasping the weapon 12. Further, the support members 30, 32 may be free to rotate to accommodate the dimensions of the forearm. Generally, the webbing (or strap) 60 may extend between the support members 30, 32 and may further provide a self-adjusting or automatically regulated surface for securely resting the support members on an operator's forearm. Further, the ability of each support 30, 32 member to pivot independently to a fixed position may provide lateral purchase against the forearm in a firing position in which the firearm assembly is generally not in alignment with the forearm. Hence, proximal accessory 12 is configured and dimensioned to stabilize the small arms weapon 10 or firearm apparatus 20 against an operator's forearm 122. This may be useful in situations in which the small arms weapon or firearm assembly is operated with a single hand.

Figure 3:
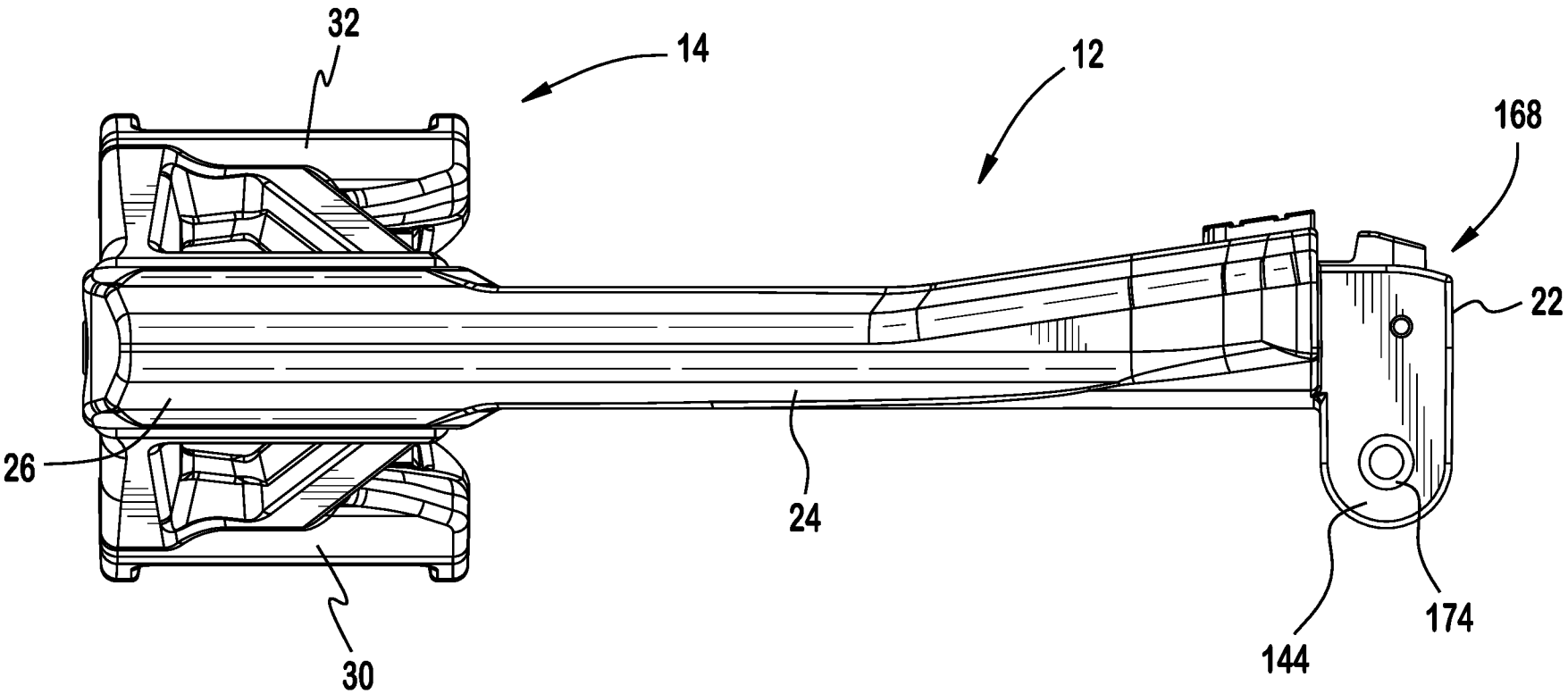
FIG. 3 is a top view of the forearm supported stabilizing device of FIG. 2.
Figure 16:
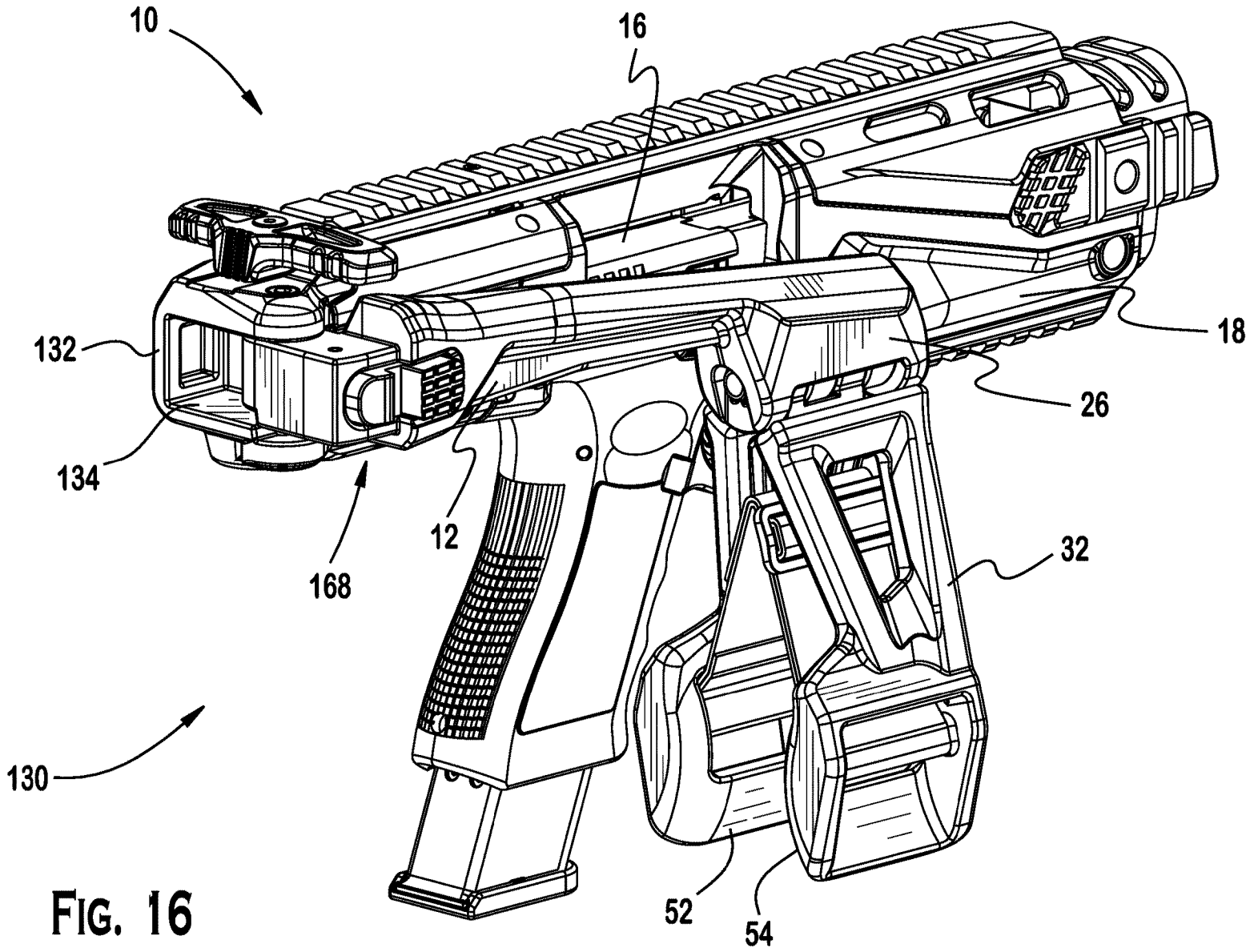
FIG. 16 is a perspective view of the small arms weapon and the forearm supported stabilizing device of FIG. 1, the forearm supported stabilizing device being in a folded configuration.

Referring to FIGS. 2, 3 and 4, the small arms weapon 10 and proximal accessory 12 may include a coupling mechanism 124 (see also, FIG. 18) for securing the proximal accessory 12 to the small arms weapon 10. The small arms weapon 10 and proximal accessory 12 further may include a latching mechanism 126 see also, FIG. 17) which may lock the proximal accessory 12 to the chassis 14 in a deployed configuration 128 (see e.g., FIG. 15) or selectively unlock the proximal accessory 12 from the chassis to allow the proximal accessory to be positioned in a folded configuration 130 (see e.g., FIG. 16). In other embodiments, however, the proximal accessory 12 can be fixed to the chassis in a deployed configuration or may be connected directly to the weapon.

Referring to FIG. 18, the proximal end 132 of the chassis 18 may include an exterior latch housing 134. The exterior latch housing may include a catch 136 and opposing fastener receiving bores 138. The distal end 140 of the proximal accessory 12 may include an interior latch housing 142 and the coupling element 144. The interior latch housing 142 may include a spring guide 146 and a set of fastener pin receiving holes 148. A compression spring 150 may be seated around the spring guide 146 and further may press against the latch 152. The latch 152 may include a button 154 and an elongated aperture 156 extending from one side to another side of the latch. The latch may further include a hook 158. The hook may include a first blocking face 160, a second blocking face 162 next to the first blocking face, and a third blocking face 164 spaced from the first and second blocking faces, respectively. A retaining pin 166 may be positioned in the retaining pin receiving holes 148 of the interior latch housing and through the elongated aperture 156 to retain the latch 152 and compression spring 150. Thus, the interior latch housing, compression spring, latch and retaining pin may be part of a latch assembly 168.

The latch assembly 168 may be inserted into the exterior latch housing 134. A coupling mechanism 124 may be used to secure the latch assembly 168 to the exterior latch housing 134. For example, a secondary hinge pin 170 and mating fastener 172 may be positioned in the opposing fastener receiving holes 138, as well as the fastener receiving hole 174 in the coupling element 144 to secure the proximal accessory 12 to the small arms weapon 10. Accordingly, the latch assembly 168 and the catch 136 may be part of a spring loaded latching mechanism 126.

In use, an operator may grasp the pistol grip of a firearm assembly with a dominant hand and then load the weapon by pulling the charging handle reward with the other hand. At the same time the support members may be forced downward on to the forearm of the user. The inner surfaces of the support members may slide around the forearm, spreading the lower portions of the support members and applying tension to the strap. The tensioned strap may conform to the forearm and apply pressure against the forearm, and thereby stabilizing the position of the firearm assembly in horizontal and vertical directions. As the pressure from the firearm assembly is reduced or withdrawn the spring bias in the hinge and the rounded inner surfaces of the support members allow the arm support to move generally unencumbered away from the forearm. Similarly, the arm support may automatically regulate and stabilize the firearm assembly from recoil. The strap length may be adjusted at the buckle achieve a secure fit between the arm support and the user's forearm.

While it has been illustrated and described what at present are considered to be preferred embodiments of the present invention, it will be understood by those skilled in the art that various changes and modifications may be made, and equivalents may be substituted for elements thereof without departing from the true scope of the invention. For example, the shape, materials of construction, and spring force of the springs may be adapted for use with a particular type of small arms weapon. Additionally, features and or elements from any embodiment may be used singly or in combination with other embodiments. Therefore, it is intended that this invention not be limited to the particular embodiment disclosed herein, but that the invention include all embodiments falling within the scope and the spirit of the present invention.

What is claimed is:

1. A stabilizing device for a small arms weapon comprising:

an elongated member comprising
- a distal end for connecting to a small arms weapon, a
- a proximal end spaced from the distal end along a first longitudinal axis, and
- a housing near the proximal end of the elongated member, the housing comprising
  - a front wall which comprises a front borehole,
  - a rear wall which comprises a rear borehole, and
  - a chamber disposed in the housing between the front wall and the rear wall;

a primary hinge pin positioned in the front borehole and the rear bore hole;

a starboard side support member which comprises
- a first leading element, and
- a first base, the first leading element comprising a first interior ring structure disposed about the primary hinge pin, and;

a port side support member which comprises
- a second leading element, and
- a second base, the second leading element including a second interior ring structure disposed about the primary hinge pin such that the primary hinge pin, the first interior ring structure, and the second interior ring structure form a joint;

a spring next to the first interior ring structure and the second interior ring structure, the spring being configured and dimensioned to bias the first base and the second base toward each other; and a webbing which comprises one end secured to the first base and another end secured to the second base, the webbing forming a sling between the starboard side support member and the port side support member, the sling being configured and dimensioned to rest on a body disposed between the first base and the second base.

2. A firearm apparatus comprising:

a pistol chassis; and a stabilizing device for a small arms weapon of claim 1 connected to the pistol chassis.

* * * * *